United States Patent [19]

Nichols et al.

[11] Patent Number: 4,803,604

[45] Date of Patent: Feb. 7, 1989

[54] ILLUMINATED SERVING TRAY

[76] Inventors: Nancie L. Nichols, c/o James Berman, 204 E. 63rd St., New York, N.Y. 10021; Bjorn Svensen, Pingvinveien 4, 3200 Sandefjord, Norway

[21] Appl. No.: 161,086

[22] Filed: Feb. 26, 1988

[51] Int. Cl.[4] ..... F21V 33/00

[52] U.S. Cl. ..... 362/154; 362/234; 362/800

[58] Field of Search ..... 362/31, 109, 234, 800, 362/154; 40/320, 324, 564

[56] References Cited

U.S. PATENT DOCUMENTS 4,254,452 3/1981 Switala ..... 362/154

4,446,508 5/1984 Kinzie ..... 362/31

4,640,033 2/1987 Bulger ..... 40/320 X

*Primary Examiner*—Stephen F. Husar

*Attorney, Agent, or Firm*—McAulay, Fields, Fisher

[57] ABSTRACT

An illuminated tray is provided for use in darkened restaurants or nightclubs. The tray has a tray housing with a peripheral rim and a flat serving surface recessed within the rim. Spaced apart LEDs are positioned on the tray rim such that the light from the LEDs, when illuminated, is visible from both above and below the tray. Spaced apart batteries for energizing the LEDs are contained within the tray housing and are positioned in a manner that is substantially symmetric with respect to the center of the tray. The tray is thus balanced along any diameter.

15 Claims, 2 Drawing Sheets

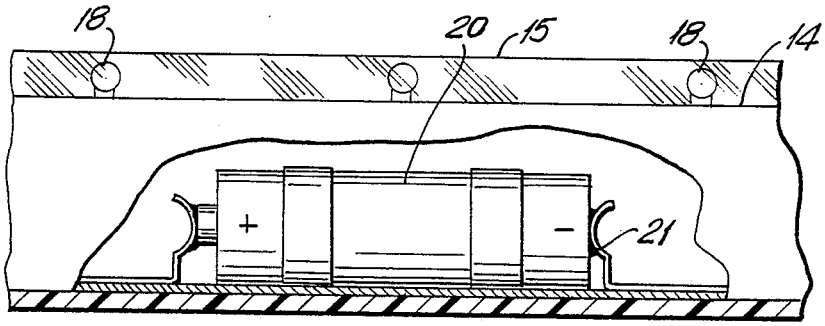
FIG.4
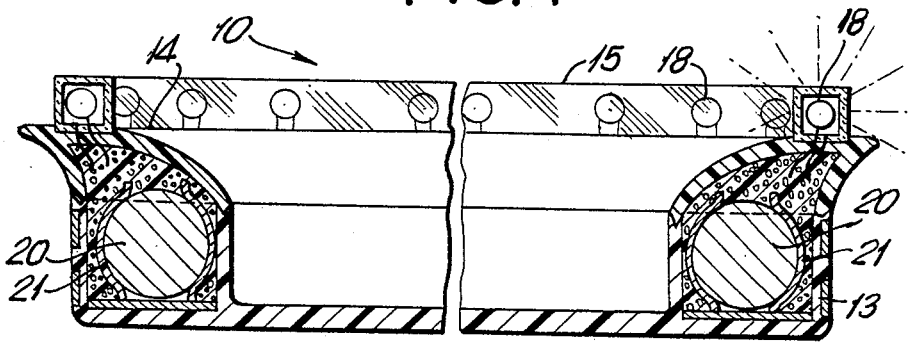
FIG.5
FIG.6
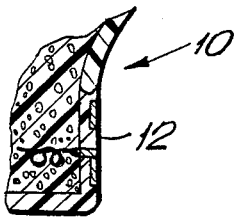

ILLUMINATED SERVING TRAY

BACKGROUND OF THE INVENTION

The present invention relates to an illuminated serving tray usable by serving people in darkened restaurants and nightclubs.

Serving trays are standardly used by waiters and waitresses in nightclubs and restaurants. These serving trays must be portable, washable, and well-balanced so that comestibles may be efficiently and hygienically served to customers.

Nightclubs and restaurants are often dimly lit to provide atmosphere. In the environment of such a darkened nightclub or restaurant it is difficult for the patrons to see the serving people. Thus it becomes difficult for the patrons to signal these serving people in order to order food and drink. Additionally, in such a darkened environment, it is often very difficult for the serving person to see the food, drinks, currency and other items which are placed upon the serving tray. Thus, the darkened environment of the restaurant can be disadvantages for efficient service.

Accordingly, it is an object of this invention to provide an illuminated serving tray which does not detract from the darkened nightclub atmosphere but which provides sufficient illumination to aid in the service of patrons.

More specifically, it is an object of the present invention to provide such an illuminated serving tray which provides light visible from both above and below the tray.

It is a further object of this invention to provide an illuminated serving tray which lights both the serving surface of that tray so that what is on the tray is more easily seen and which lights the tray in a manner to allow the tray to be visible from a distance.

Yet another object of this invention is to provide such a tray which is easily cleaned so that the tray can be both hygienic and aesthetically pleasing.

Still further object of this invention is to provide such an illuminated tray which is well-balanced.

BRIEF DESCRIPTION

In one embodiment of the present invention a substantially circular serving tray is provided. The tray includes a tray housing having a peripheral rim. The tray has a substantially flat serving surface which is recessed within the peripheral rim. A number of spaced apart light emitting diodes (hereinafter LEDs) are positioned on the peripheral rim. The LEDs when energized provide light which is visible from both above and below the illuminated tray. The light emitted by the LEDs illuminates the tray-serving surface.

BRIEF DESCRIPTION OF THE DRAWINGS

FIG. 4 is a fragmentary sectional view of the FIG. 1 tray.

FIG. 5 is a sectional view partially broken away taken along line 5—5 of FIG. 1.

FIG. 6 is a fragmentary sectional view of the FIG. 1 tray.

DESCRIPTION OF THE PREFERRED EMBODIMENT

Figure 1:
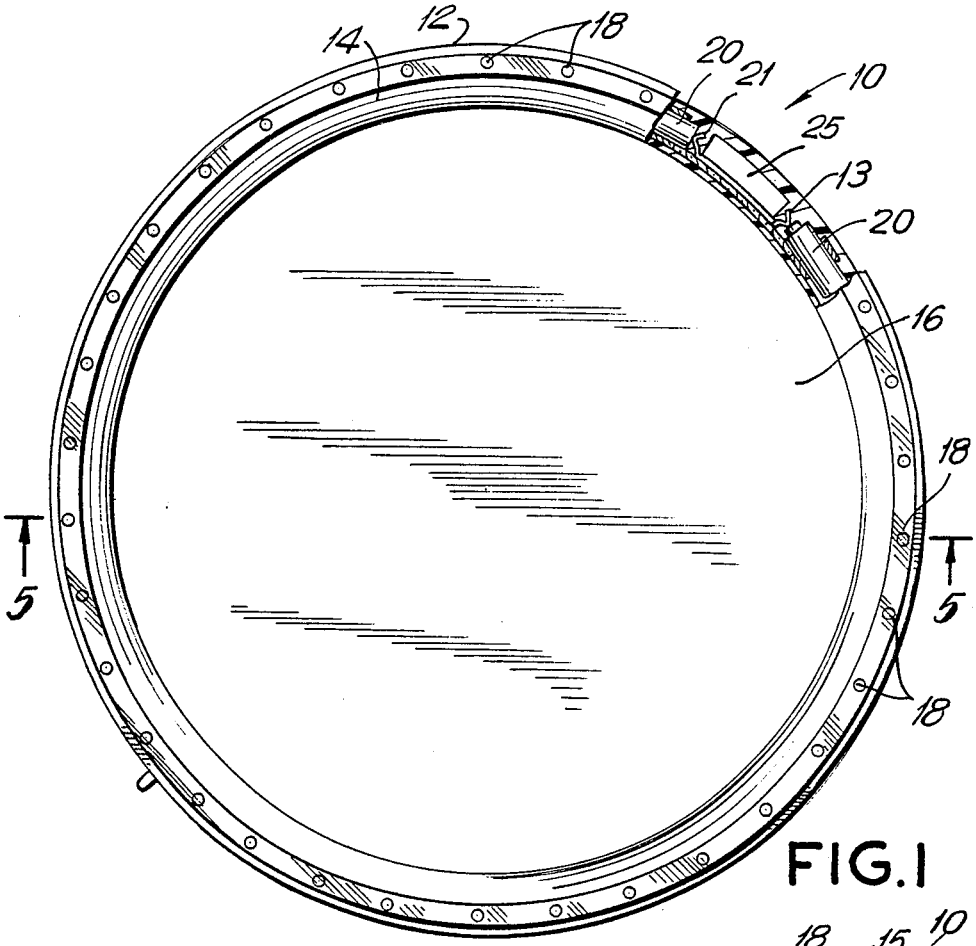
FIG. 1 is a top plan view of the illuminated serving tray of the present invention.
Figure 2:
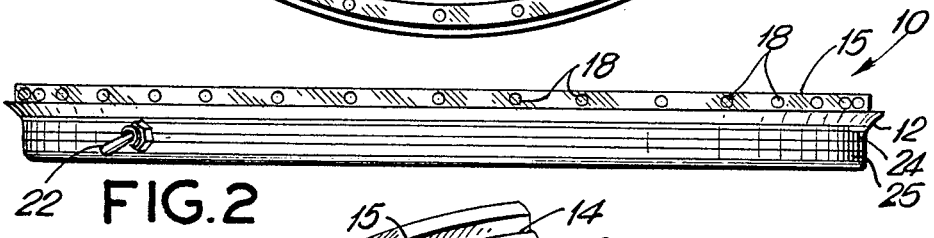
FIG. 2 is a front elevational view of the FIG. 1 tray.
Figure 3:
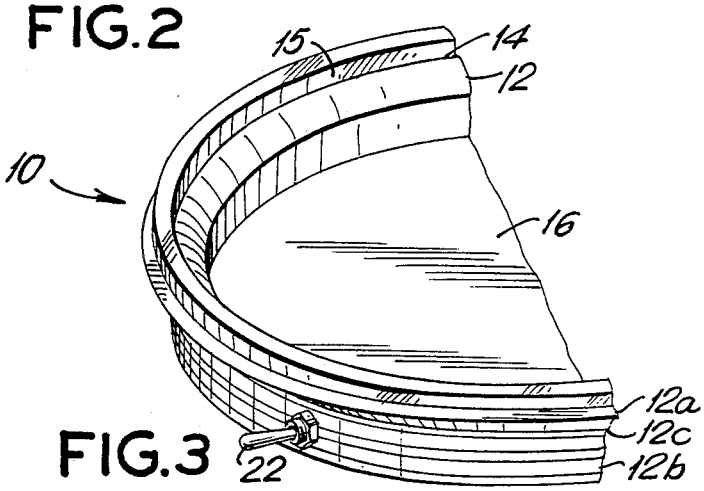
FIG. 3 is a partial perspective view of the FIG. 1 tray.

Referring now to the drawings, the reference numeral 10 denotes the illuminated tray of the present invention. Tray 10 includes a tray housing 12 with peripheral rim 14. A substantially flat serving surface 16 is recessed within peripheral rim 14 of the housing 12. The tray housing 12 is a two piece construction having an upper portion **12*a* and a lower portion 12*b* which are separately molded but which are sealed together along sealing seam 12*c*** using known methods.

A plurality of spaced-apart LEDs 18 are positioned on peripheral rim 14. LEDs 18 encircle peripheral rim 14 and provide symmetrical illumination. As shown in the drawings LEDs 18 are protected within a transparent cover or tube 15 to protect the LEDs from damage.

As best shown in FIG. 5, the shape and dimension of peripheral rim 14 in combination with the position of the LEDs on said rim provide illumination over an arc of at least 270 degrees when the LEDs are energized. The illumination thus provided lights serving surface 16 of tray 10 so that what is on that serving surface is easily visible. It also lights the tray sufficiently so that patrons sitting at a distance from a serving person holding tray 10 can see the tray. In place of LEDs, incandescent bulbs or other appropriate lighting means may be used to light illuminated tray 10.

An annular chamber 13 within the rim 14 of the tray housing 12 contains ten series-connected rechargeable 1.2 volt batteries 20. Rechargeable batteries 20 are evenly spaced from one another and positioned about the perimeter of the tray housing 12. By positioning rechargeable batteries 20 in this manner the weight of the batteries is symmetrical and does not cause the tray to be unbalanced. Rechargeable batteries 20 provide a self-contained source of sufficient electrical current to energize LEDs 18. Non-chargeable batteries or other appropriate energizing means may be used to energize LEDs 18.

Each rechargeable battery 20 is soldered to a contact clip 21. By soldering the batteries to the clips accidental loss of contact when the tray is in use is avoided. A switch 22 is provided which is connected to batteries 20 and LEDs 18. The switch is used to selectively place LEDs 18 in an energized or a non-energized state. Spaces 25 are provided between the batteries 20 to enhance the symmetry of weight of the tray 10 and to provide room for additional electronic components if desired. Prior to the sealing of tray housing portions **12*a* and 12*b*, the batteries 20 are soldered to the contact clips 21 and placed within annulus 13. Appropriate holes are drilled in tray 10 to allow wires to connect the batteries 20 to switch 22 and LEDs 18. After the wires are drawn through the holes into appropriate position and the electrical wiring of tray 10 completed the holes can be sealed using plastic or other sealing means and tray housing portions 12*a* and 12*b* can be sealed to one another. For additional security all non-used space in annulus 13 can be filled with a light foam insulation before the final assembly of the tray 10**.

In a preferred embodiment tray 10 is made of polypropylene. Circular conductive bands 24, 25 made of non-corrosive material, are molded into the tray housing 12. Conductive bands 24, 25 are used in conjunction with an appropriate charging unit to recharge the rechargeable batteries 20. Conductive bands 24 are formed with struts thereon to provide appropriate electronic connections with the batteries 20. Tray 10, with conductive bands 24, 25 is waterproof and tray 10 can be washed without being damaged.

A variety of different lighting effects can be provided for tray 10. A simple arrangement where a non-blinking light is provided may be desired. Alternatively, more decorative light effects such as lights which blink or spin may be provided. Depending on the light effects, tray 10 may provide additional decorative adornment to enhance the atmosphere of the nightclub or restaurant.

When the LEDs 18 are activated a customer can easily see the serving person carrying the illuminated tray 10. Thus, the customer can more easily call the service person over to obtain service. Additionally, the lighted tray illuminates the serving person and prevents customers from accidentally bumping into the serving person in a dimly lit restaurant or nightclub.

What is claimed:

1. An illuminated serving tray comprising:

a tray housing having a peripheral rim;

a substantially flat serving surface recessed within said rim;

a light means positioned on said rim such that the light from said light means is visible from both above and below said illuminated tray and such that said light illuminates said serving surface; and self-contained means for energizing said light means, said energizing means being positioned in a manner that is substantially symmetric with respect to the center of said tray such that the illuminated tray is balanced about any diameter.

2. The illuminated serving tray of claim 1 wherein the light means encircle the rim to provide symmetrical illumination.

3. The illuminated serving tray of claim 1 wherein the light means project upwardly from said rim.

4. The illuminated serving tray of claim 2 wherein the light means project upwardly from said rim.

5. The illuminated serving tray of claim 1 wherein the light means is a plurality of spaced apart incandescent bulbs.

6. The illuminated serving tray of claim 1 wherein the light means is a plurality of spaced apart light emiting diodes.

7. The illuminated serving tray of claim 1 wherein said energizing means is a plurality of series connected batteries.

8. The illuminated serving tray of claim 7 wherein the batteries are rechargeable 1.2 volt batteries.

9. The illuminated serving tray of claim 7 wherein said tray housing is a two-piece construction and wherein one piece of said two-piece construction is formed with a battery receiving annulus therein, said series connected batteries being held within said annulus.

10. The illuminated serving tray of claim 9 further including contact clips to which said batteries are soldered.

11. The illuminated serving tray of claim 7 wherein said batteries are evenly spaced from one another and peripherally disposed within said tray housing.

12. The illuminated serving tray of claim 1 wherein said tray is substantially water-immersible to allow said tray to be washed.

13. The illuminated serving tray of claim 8 wherein the tray is formed of plastic having conductive bands therein for recharging the rechargeable batteries.

14. The illuminated serving tray of claim 13 wherein the tray is made of polypropylene.

15. The tray of claim 1 wherein:

said light means comprises a plurality of light sources encircling the upper surface of said rim, the width of the upper surface of said rim being narrow enough to provide illumination over an area of at least 270 degrees.

* * * * *